US007665827B2

(12) United States Patent
Igarashi et al.

(10) Patent No.: US 7,665,827 B2
(45) Date of Patent: Feb. 23, 2010

(54) LIQUID DISCHARGE RECORDING HEAD HAVING AN IMPROVED OXETANE RESIN COVERING LAYER AS PART OF A LIQUID FLOW PATH AND LIQUID DISCHARGE APPARATUS

(75) Inventors: Koichi Igarashi, Kanagawa (JP); Shogo Ono, Kanagawa (JP); Manabu Tomita, Kanagawa (JP); Minoru Kohno, Tokyo (JP)

(73) Assignee: Sony Corporation, Tokyo (JP)

( * ) Notice: Subject to any disclaimer, the term of this patent is extended or adjusted under 35 U.S.C. 154(b) by 553 days.

(21) Appl. No.: 11/551,299

(22) Filed: Oct. 20, 2006

(65) Prior Publication Data

US 2007/0195133 A1 Aug. 23, 2007

(51) Int. Cl.
*B41J 2/05* (2006.01)

(52) U.S. Cl. ..... 347/64; 347/63

(58) Field of Classification Search ..... 347/20, 347/56, 61–65, 67, 44, 47
See application file for complete search history.

(56) References Cited

U.S. PATENT DOCUMENTS 7,282,243 B2 * 10/2007 Ohkuma et al. ..... 427/510

FOREIGN PATENT DOCUMENTS

| | | |
|---|---|---|
| JP | 2002-169279 | 6/2002 |
| JP | 2004-002668 | 1/2004 |
| JP | 2005-074747 | 3/2005 |
| JP | 2005-154734 | 6/2005 |
| JP | 2006-159762 | 6/2006 |

OTHER PUBLICATIONS

Japanese Patent Office Action corresponding to Japanese Serial No. 2005-229902 dated Oct. 20, 2009.

* cited by examiner

*Primary Examiner*—Juanita D Stephens
(74) *Attorney, Agent, or Firm*—Sonnenschein Nath & Rosenthal LLP

(57) ABSTRACT

A liquid discharge recording head which discharges a liquid includes a substrate on which liquid-discharge-energy-generating elements are provided and which constitutes a part of a flow path for supplying the liquid; and a covering resin layer which is provided on the substrate, which constitutes a part of the flow path, and which includes orifices for discharging the liquid, wherein the covering resin layer is composed of an oxetane resin composition containing an oxetane compound having at least one oxetanyl group in its molecule and a photocationic polymerization initiator as essential components.

26 Claims, 10 Drawing Sheets

LIQUID DISCHARGE RECORDING HEAD HAVING AN IMPROVED OXETANE RESIN COVERING LAYER AS PART OF A LIQUID FLOW PATH AND LIQUID DISCHARGE APPARATUS

CROSS REFERENCES TO RELATED APPLICATIONS

The present application contains subject matter related to Japanese Patent Application JP 2005-229902 filed in the Japanese Patent Office on Aug. 8, 2005, the entire contents of which are incorporated herein by reference. The benefit of priority is not claimed.

BACKGROUND OF THE INVENTION

1. Field of the Invention

The present invention relates to a liquid discharge recording head including highly accurate flow paths that have a low stress and satisfactory chemical resistance and that are formed by patterning with ultraviolet irradiation or the like, and a liquid discharge apparatus including the same.

2. Description of the Related Art

An example of liquid discharge apparatuses is an ink-jet printer apparatus that discharges, for example, ink as a liquid and that employs an ink-jet recording method (liquid-jet recording method). Such an ink-jet printer apparatus includes an ink-jet recording head for discharging ink. The ink-jet recording head includes a plurality of constituent units each composed of a discharge port (i.e., orifice) that discharges ink in the form of a minute droplet, a flow path communicating with the orifice, and an ink-discharge-pressure-generating element provided on a part of the flow path. In order to produce high-quality images using such an ink-jet recording head, small droplets of ink discharged from the orifices are preferably discharged from each orifice at a constant volume and a constant discharging rate.

Examples of ink-jet recording heads that meet the above discharging conditions include ink-jet recording heads described in Japanese Unexamined Patent Application Publication Nos. 56-123869, 57-208255, and 57-208256. In the ink-jet recording heads described in Japanese Unexamined Patent Application Publication Nos. 56-123869, 57-208255, and 57-208256, ink flow paths and nozzles composed of orifice parts are formed on a substrate having ink-discharge-pressure-generating elements by patterning a photosensitive resin material or a photoresist, and a cover such as a glass plate is bonded on the component having the ink flow paths and the nozzles. Examples of the photosensitive resin material and the photoresist include photopolymers using photopolymerization of a diazo resin, p-diazoquinone, or a vinyl monomer in the presence of a polymerization initiator; dimerization-type photopolymers using a reaction of polyvinyl cinnamate or the like and a sensitizer; mixtures of orthoquinone diazide and a phenol novolak resin; mixtures of polyvinyl alcohol and a diazo resin; polyether photopolymers prepared by copolymerizing 4-glycidylethylene oxide with benzophenone or glycidylchalcone; copolymers of N,N-dimethylmethacrylamide and, for example, acrylamide benzophenone; unsaturated polyester photosensitive resins; unsaturated urethane photosensitive resins; photosensitive compositions prepared by mixing a bifunctional acrylic monomer, a photoinitiator, and a polymer; dichromate photoresists; non-chromium water-soluble photoresists; and polyvinyl cinnamate photoresists.

Another example of an ink-jet recording head that meets the above discharging conditions is an ink-jet recording head produced by a method described in Japanese Unexamined Patent Application Publication No. 61-154947. According to the method of producing an ink-jet recording head described in Japanese Unexamined Patent Application Publication No. 61-154947, a pattern of ink flow paths is formed on a part of a substrate, the part in which the ink flow paths are formed, using a soluble resin; the pattern of the ink flow paths is covered with an epoxy resin or the like; the substrate is cut; and the soluble resin forming the pattern of ink flow paths is then removed by dissolving, thereby producing the ink-jet recording head.

In the ink-jet recording heads described in Japanese Unexamined Patent Application Publication Nos. 56-123869, 57-208255, 57-208256, and 61-154947, for example, a heating resistor, which serves as an ink-discharge-pressure-generating element provided on a part of an ink flow path, is provided in a direction parallel to the flow of ink. Each orifice that discharges the ink is provided at an end of the corresponding ink flow path and in a direction perpendicular to the flow of the ink. In such ink-jet recording heads, the orifice is disposed so as to be substantially perpendicular to the heating resistor. Consequently, the discharge direction of ink is perpendicular to the growth direction of a bubble formed on the heating resistor. That is, the growth direction of the bubble is different from the discharge direction of the ink.

In such ink-jet recording heads, since a part of an orifice disposed at an end of the corresponding ink flow path is formed of an end of a substrate, the distance between the ink-discharge-pressure-generating element and the orifice is determined by cutting of the substrate. Therefore, in controlling the distance between the ink-discharge-pressure-generating element and the orifice, the accuracy with which the substrate is cut is very important. The substrate is generally cut with a mechanical device such as a dicing saw, and it is difficult to realize high accuracy with such a mechanical device.

Unlike the ink-jet recording heads described in Japanese Unexamined Patent Application Publication Nos. 56-123869, 57-208255, 57-208256, and 61-154947, in other ink-jet recording heads, for example, an electrothermal conversion element, which is an ink-discharge-pressure-generating element, is provided so as to face an orifice. Thus, the growth direction of a bubble formed on the electrothermal conversion element is substantially the same as the discharge direction of ink. For example, Japanese Unexamined Patent Application Publication Nos. 58-8658 and 62-264957 describe such ink-jet recording heads. In the ink-jet recording head described in Japanese Unexamined Patent Application Publication No. 58-8658, a dry film serving as an orifice plate is bonded to a substrate having electrothermal conversion elements, with another patterned dry film therebetween, and orifices are formed on the dry film serving as the orifice plate by photolithography at positions facing the electrothermal conversion elements. In the ink-jet recording head described in Japanese Unexamined Patent Application Publication No. 62-264957, a substrate having ink-discharge-pressure-generating elements is bonded to an orifice plate produced by electroforming, with a patterned dry film therebetween.

In the ink-jet recording heads described in Japanese Unexamined Patent Application Publication Nos. 58-8658 and 62-264957, the orifice plate has a small thickness of, for example, 20 μm or less, and it is difficult to produce the orifice plate uniformly. Furthermore, in these ink-jet recording heads, even when the orifice plate can be produced, it is extremely difficult to perform the process of bonding with the substrate having ink-discharge-pressure-generating elements because of the brittleness of the orifice plate.

Furthermore, regarding discharging conditions in ink-jet recording heads, it is necessary not only to discharge ink from orifices at a constant volume and a constant discharging rate, but also to discharge minute ink droplets at precise positions. In ink-jet recording heads, in order to discharge ink at precise positions, the distance between an electrothermal conversion element provided at a discharge-energy-generating part and an orifice (hereinafter referred to as "OH distance") is preferably small.

An example of a method of producing an ink-jet recording head having a highly precise OH distance is a method described in Japanese Unexamined Patent Application Publication No. 6-286149. This patent document describes a method of producing an ink-jet recording head including the steps of forming an ink flow path pattern that forms ink flow paths on a substrate having ink-discharge-pressure-generating elements using a soluble resin, forming a covering resin layer that forms an ink flow path wall on the soluble resin layer by performing solvent coating of a solution, prepared by dissolving a covering resin containing an epoxy resin that is a solid at room temperature in a solvent, on the soluble resin layer constituting the ink flow path pattern, forming orifices on the covering resin layer disposed on an upper part of each of the ink-discharge-pressure-generating elements, and removing the soluble resin layer constituting the ink flow path pattern by dissolving. In the method of producing an ink-jet recording head described in this patent document, in view of the formation of a pattern having a high aspect ratio and a property of ink resistance, a cationic polymer of an alicyclic epoxy resin is used as the covering resin.

In ink-jet recording heads, the use of the methods and the materials described in Japanese Unexamined Patent Application Publication Nos. 6-286149 and 7-214783 causes the following additional problems.

The cured product prepared by cationic polymerization of such an alicyclic epoxy resin has excellent adhesive force with a base substrate. However, because of a high internal stress of the cured product, the covering resin layer made of the cured product is peeled off from the base substrate. Furthermore, in the cured product prepared by cationic polymerization of an alicyclic epoxy resin, cracks (film breakages) are also generated particularly in the vicinity of a corner, e.g., a pattern edge, of the resin film on which a stress is concentrated, thereby significantly degrading the reliability as an ink-jet recording head. In addition, some of these materials have insufficient patterning performance and do not provide the minute patterning performance for forming the structure of an ink-jet recording head.

In ink-jet recording heads, in particular, when the covering resin layer serving as an ink flow path wall is formed so as to have an elongated shape or a large thickness, and when the ink flow path has a minute and complex structure, the covering resin layer is easily peeled off or cracks on the covering resin layer are easily generated. Furthermore, in ink-jet recording heads, in order to maintain the image quality, the head surface from which ink is discharged is cleaned so as to remove extra ink adhered to the head surface. In the head cleaning of an ink-jet recording head, since the head surface is wiped with a cleaning component or the like, a mechanical load is applied to the head surface, which may accelerate the removal of the covering resin layer from a substrate.

SUMMARY OF THE INVENTION

It is desirable to provide a liquid discharge recording head including a coating film that has a low stress and that can be precisely and easily formed by patterning with ultraviolet irradiation or the like, and a liquid discharge apparatus including the same.

A liquid discharge recording head according to an embodiment of the present invention discharges a liquid and includes a substrate on which liquid-discharge-energy-generating elements are provided and which constitutes a part of a flow path for supplying the liquid; and a covering resin layer which is provided on the substrate, which constitutes a part of the flow path, and which includes orifices for discharging the liquid. The covering resin layer of this liquid discharge recording head is composed of an oxetane resin composition containing an oxetane compound having at least one oxetanyl group in its molecule and a photocationic polymerization initiator as essential components.

A liquid discharge apparatus according to an embodiment of the present invention includes the above liquid discharge recording head.

Furthermore, a liquid discharge recording head according to another embodiment of the present invention discharges a liquid and includes a liquid supply component having a recess which constitutes a part of a common flow path for supplying the liquid; a first substrate which is bonded on one side of the recess of the liquid supply component, an end face of which constitutes a part of the common flow path, and on which liquid-discharge-energy-generating elements are provided; a first covering resin layer which is provided on the first substrate and which includes individual flow paths for supplying the liquid supplied from the common flow path to the periphery of the liquid-discharge-energy-generating elements and orifices for discharging the liquid; a second substrate which is bonded on another side of the recess of the liquid supply component and an end face of which constitutes a part of the common flow path; a second covering resin layer provided on the second substrate; and a top plate which is provided on the first covering resin layer and the second covering resin layer and which closes the side of a discharge face of the common flow path. The first covering resin layer of this liquid discharge recording head is composed of an oxetane resin composition containing an oxetane compound having at least one oxetanyl group in its molecule and a photocationic polymerization initiator as essential components.

A liquid discharge apparatus according to another embodiment of the present invention includes the above liquid discharge recording head.

According to an embodiment of the present invention, a covering resin layer that constitutes a part of a flow path and that includes orifices, or a first covering resin layer having individual flow paths and orifices is composed of an oxetane resin composition. Because oxetane compounds are characterized as low-stress materials, the stress in the covering resin layer can be reduced, the generation of cracks can be prevented, the removal from a substrate can be prevented, and excellent durability can be provided. Furthermore, according to an embodiment of the present invention, since the covering resin layer or the first covering resin layer is composed of an oxetane resin composition, chemical resistance can be provided. Therefore, according to an embodiment of the present invention, the production yield and the quality are improved, thereby achieving high reliability for a long time.

DESCRIPTION OF THE PREFERRED EMBODIMENTS

A liquid discharge recording head and a liquid discharge apparatus according to an embodiment of the present invention will now be described with reference to the drawings. The liquid discharge apparatus is an ink-jet printer apparatus that discharges, for example, ink as a liquid, and an ink-jet recording head, which is the liquid discharge recording head, is provided in this printer apparatus.

Figure 1:
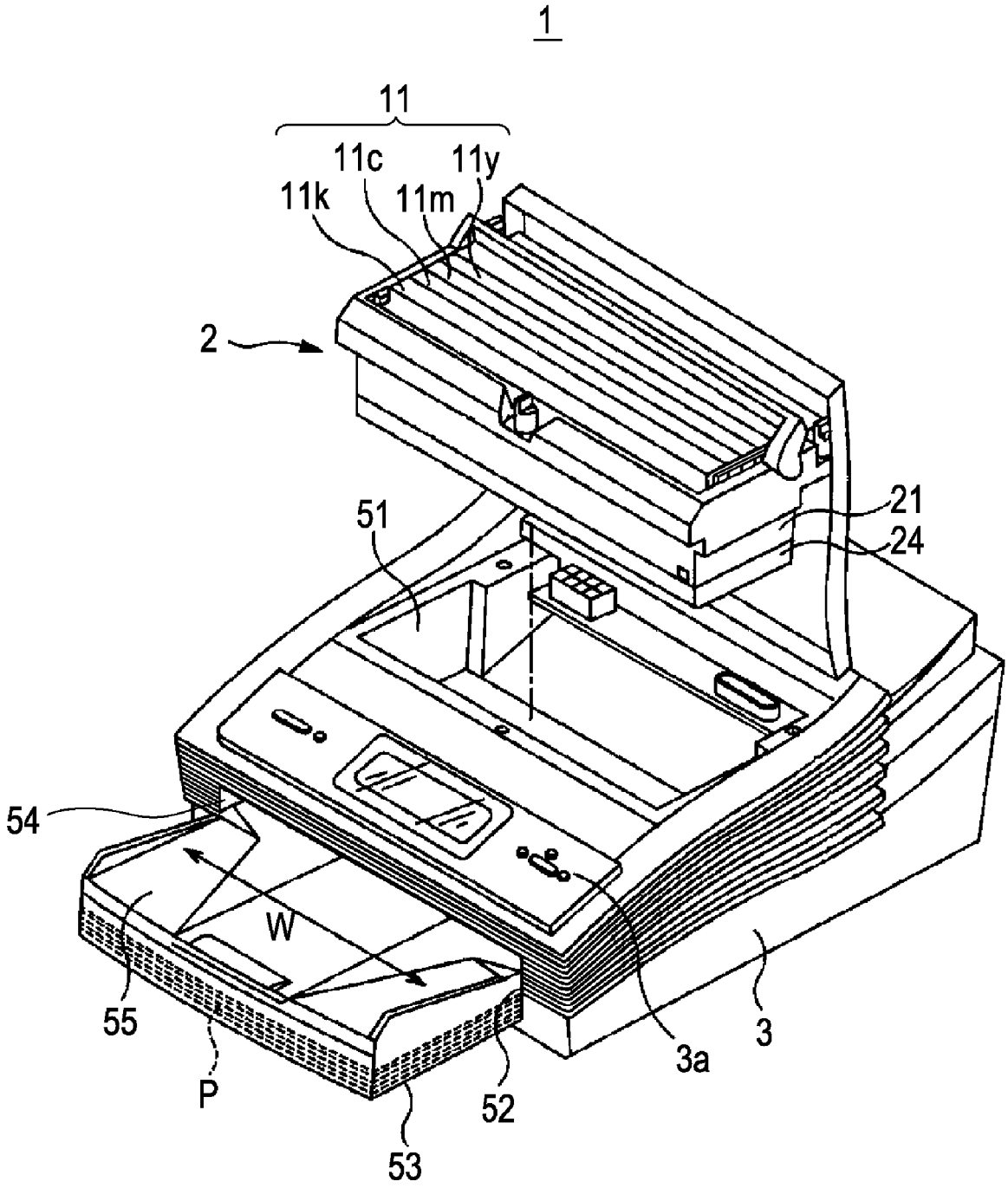
FIG. 1 is a perspective view of an ink-jet printer apparatus according to an embodiment of the present invention.

As shown in FIG. 1, an ink-jet printer apparatus (hereinafter referred to as printer apparatus) 1 includes an ink-jet printer head cartridge (hereinafter referred to as head cartridge) 2 that discharges ink i onto an object, e.g., recording paper P, and a main body 3 to which the head cartridge 2 is installed. This printer apparatus 1 is a so-called line printer apparatus in which ink orifices (nozzles) are arrayed substantially in the form of at least one line in the width direction of the recording paper P, i.e., in the direction of an arrow W in FIG. 1. In the printer apparatus 1, the head cartridge 2 is detachable from the main body 3.

Figure 2:
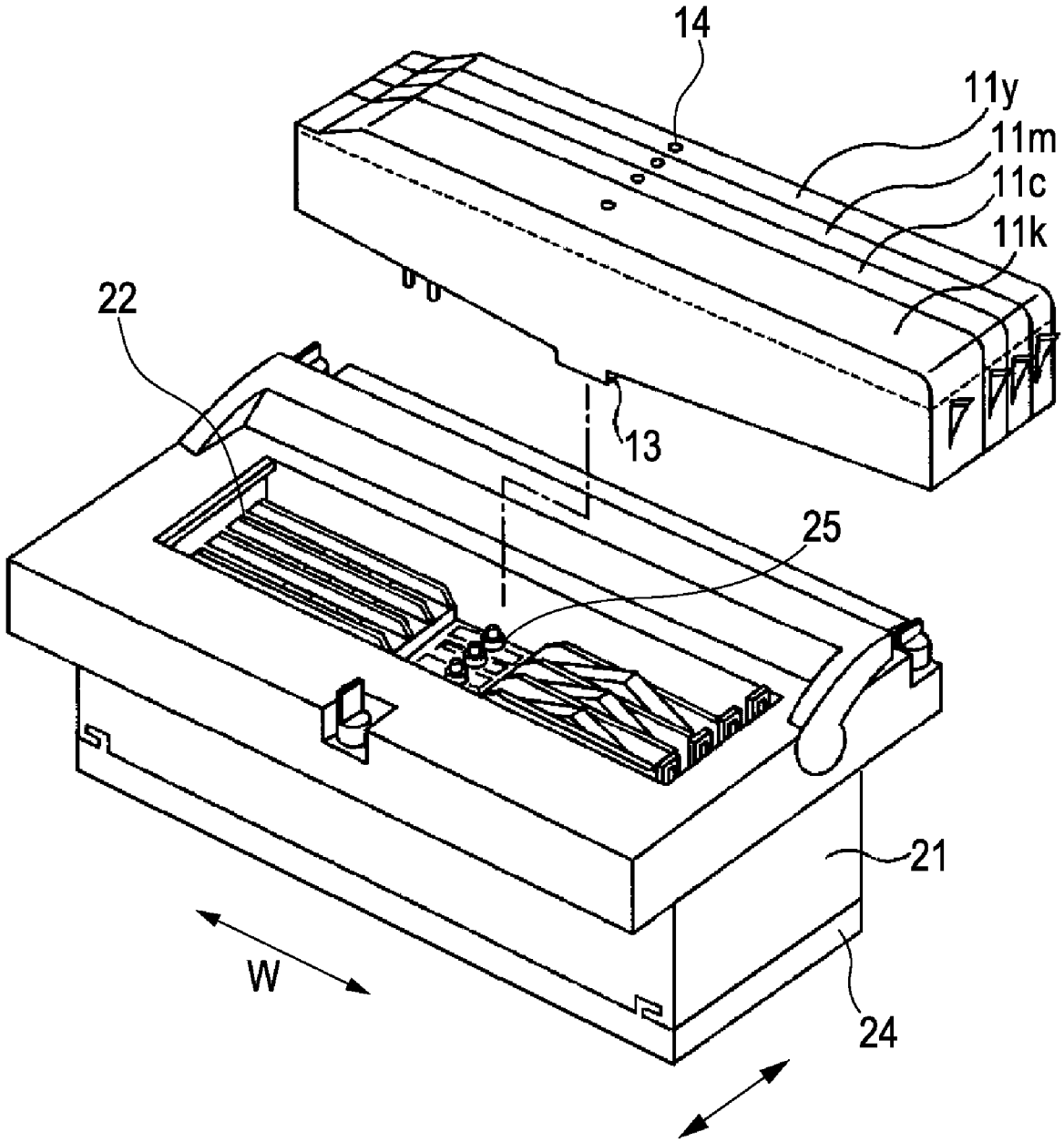
FIG. 2 is a perspective view of a head cartridge provided in the ink-jet printer apparatus.
Figure 3:
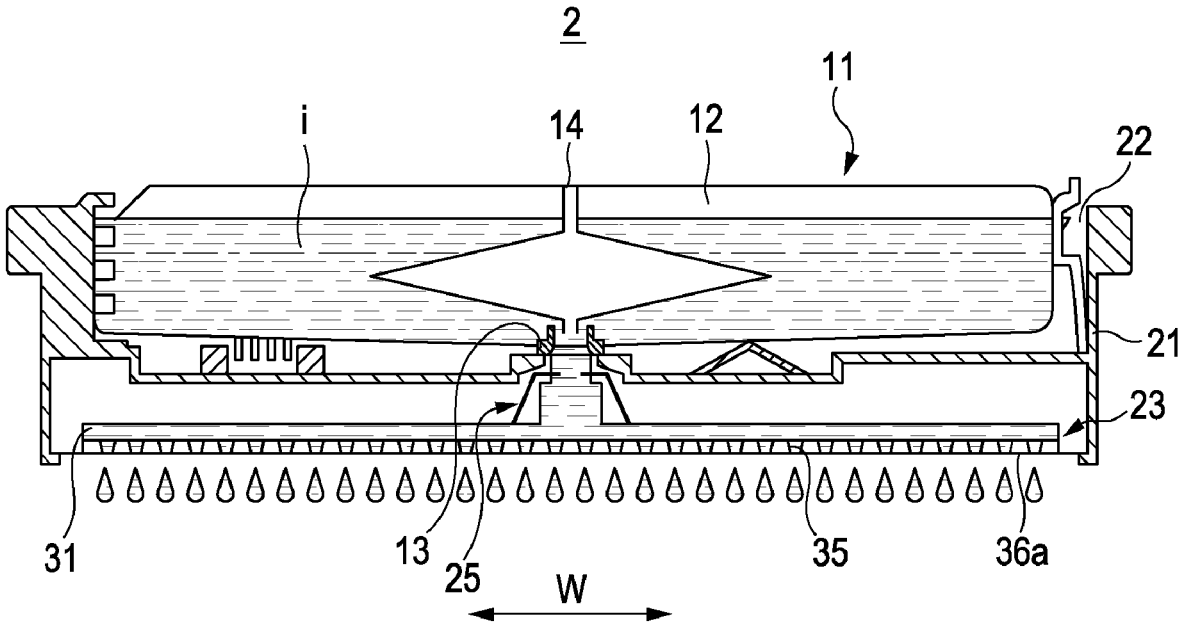
FIG. 3 is a cross-sectional view of the head cartridge.

First, the head cartridge 2 constituting the printer apparatus 1 will be described. The head cartridge 2 discharges the ink i using, for example, an electrothermal-conversion-type heating resistor as a pressure-generating element to deposit the ink i onto the principal surface of the recording paper P. As shown in FIGS. 2 and 3, an ink cartridge 11, which is a container accommodating the ink i, is attached to the head cartridge 2. The ink cartridge 11 includes an ink cartridge 11*y* of yellow ink, an ink cartridge 11*m* of magenta ink, an ink cartridge 11*c* of cyan ink, an ink cartridge 11*k* of black ink for yellow ink, magenta ink, cyan ink, and black ink, respectively. The ink cartridge 11 has a cuboidal shape that substantially has the same dimension as that in the width direction of the recording paper P. More specifically, as shown in FIG. 3, the ink cartridge 11 includes an ink-accommodating part 12 that accommodates the ink i, and an ink supply part 13 for discharging the ink i to a cartridge body 21 of the head cartridge 2 is provided on the lower surface of the ink-accommodating part 12.

An external communicating hole 14, which serves as a hole for introducing the outside air, is provided at the center of the upper surface of the ink-accommodating part 12. In the ink cartridge 11, when the ink i is supplied to the cartridge body 21, an amount of air corresponding to the amount of reduced ink i is supplied through the external communicating hole 14.

The ink supply part 13 is provided near the center of the lower side of the ink-accommodating part 12. The ink supply part 13 is a nozzle that substantially has a protruding shape and that communicates with the ink-accommodating part 12. The leading end of this nozzle is fitted with a connecting part 25 of the head cartridge 2 described below, thereby connecting the ink-accommodating part 12 of the ink cartridge 11 to the cartridge body 21 of the head cartridge 2.

In the ink supply part 13, a supply port for supplying the ink i to the side of the cartridge body 21 is provided at the bottom surface side of the ink cartridge 11, and the supply port is opened or closed by a valve mechanism (not shown in detail in the figure). The ink cartridge 11 is attached to the cartridge body 21. When the ink supply part 13 is connected to the connecting part 25 of the head cartridge 2, the valve is moved away from the supply port to open the supply port. Accordingly, the ink i is supplied to the side of the head cartridge 2.

As shown in FIGS. 2 and 3, the head cartridge 2 to which the ink cartridge 11 is attached includes the cartridge body 21. The cartridge body 21 includes an attaching part 22 to which the ink cartridge 11 is attached, an ink-jet recording head 23 that discharges the ink i, and a head cap 24 that protects the ink-jet recording head 23.

The connecting part 25 that is connected to the ink supply part 13 of the ink cartridge 11 attached to the attaching part 22 is provided substantially in the center in the longitudinal direction of the attaching part 22. This connecting part 25 serves as a supply path for supplying the ink i from the ink supply part 13 of the ink cartridge 11 attached to the attaching part 22 to the ink-jet recording head 23 that is provided on the bottom surface of the cartridge body 21 and that discharges the ink i. The connecting part 25 controls the supply of the ink i from the ink cartridge 11 to the ink-jet recording head 23 with a valve mechanism.

The ink-jet recording head 23 to which the ink i is supplied from the connecting part 25 is provided along the bottom surface of the cartridge body 21. In the ink-jet recording head 23, nozzles 35 described below, which are orifices that discharge the ink i supplied from the connecting part 25, are arrayed substantially in the form of a line in the width direction of the recording paper P, i.e., in the direction of an arrow W in FIG. 3. The ink-jet recording head 23 discharges the ink i from each nozzle line without moving in the width direction of the recording paper P.

Figure 4:
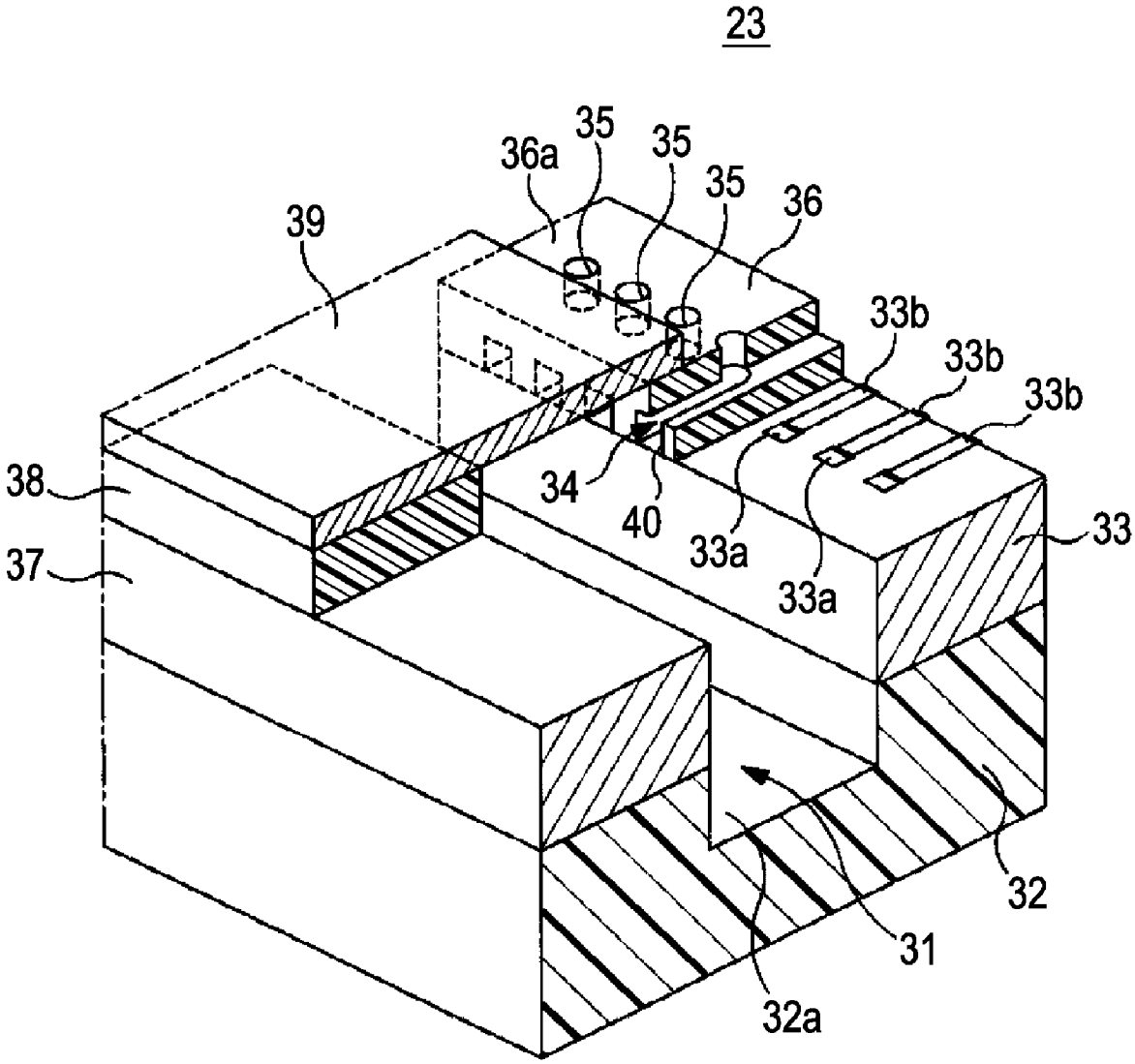
FIG. 4 is a perspective view showing a part of an ink-jet recording head according to an embodiment of the present invention.
Figure 5:
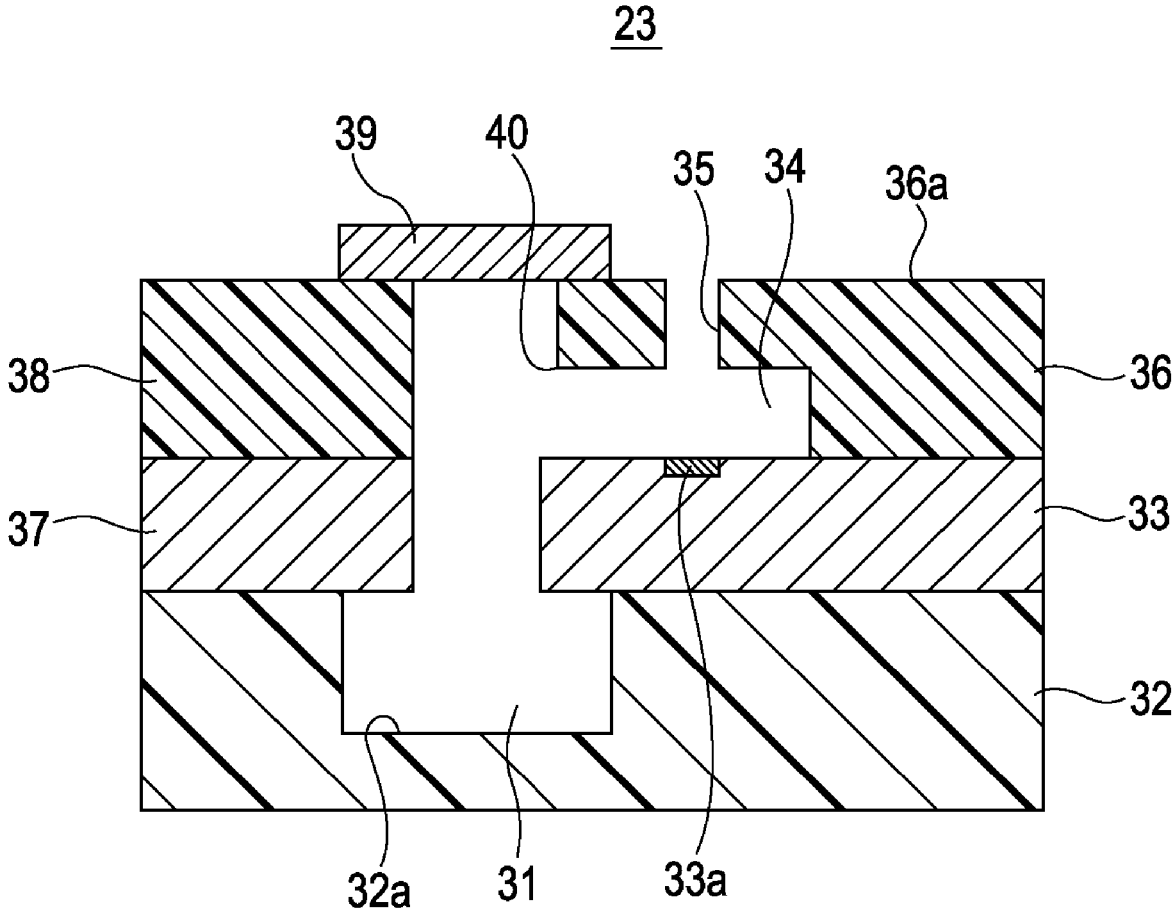
FIG. 5 is a cross-sectional view of the ink-jet recording head.

As shown in FIGS. 4 and 5, the ink-jet recording head 23 includes an ink supply component 32 in which a recess 32*a* constituting a part of a common flow path 31 is provided, a first substrate 33 provided on one side of the recess 32*a* of the ink supply component 32, a first covering resin layer 36 provided on the first substrate 33 and having individual flow paths 34 and nozzles 35 thereon, a second substrate 37 provided on another side of the recess 32*a* of the ink supply component 32 and having the same height as the first substrate 33, a second covering resin layer 38 provided on the second substrate 37 and having the same height as the first covering resin layer 36, and a top plate 39 that is provided on the first covering resin layer 36 and the second covering resin layer 38 and that closes the common flow path 31.

The ink-jet recording head 23 includes the common flow path 31 surrounded by the ink supply component 32, an end face of the first substrate 33, an end face of the first covering resin layer 36, an end face of the second substrate 37, and an end face of the second covering resin layer 38, and the top plate 39; and the individual flow paths 34 constituting liquid chambers in which discharge-energy-generating elements 33*a* are surrounded by the first substrate 33 and the first covering resin layer 36. In the ink-jet recording head 23, the ink i supplied from the ink cartridge 11 is supplied to the common flow path 31, and the ink i supplied from the common flow path 31 is then supplied to each of the individual flow paths 34.

The ink supply component 32 constituting a part of the common flow path 31 is composed of an ink-resistant resin or the like, and the recess 32*a* constituting a part of the common flow path 31 is provided on the ink supply component 32.

The first substrate 33 is, for example, a silicon substrate, and a plurality of electrothermal conversion elements serving as discharge-energy-generating elements 33*a* are provided at predetermined positions on the surface of the first substrate 33 by a semiconductor process. Control circuits 33*b* that control the discharge-energy-generating elements 33*a* are also provided on the first substrate 33. An end face of the first substrate 33, the end face being adjacent to the common flow path 31, constitutes a part of the common flow path 31. In the first substrate 33, a surface on which the discharge-energy-generating elements 33*a* are provided constitutes the bottom surface of the individual flow paths 34. The discharge-energy-generating elements 33*a* are not limited to the electrothermal conversion elements and may be electromechanical conversion elements such as piezoelectric elements.

The first covering resin layer 36 is formed on the first substrate 33 by patterning. The first covering resin layer 36 includes the individual flow paths 34 that supply the ink i from the common flow path 31 to the periphery of each of the discharge-energy-generating elements 33*a* provided on the first substrate 33, and the nozzles 35 that discharge the ink i to positions facing the discharge-energy-generating elements 33*a*. The individual flow paths 34 are provided for corresponding discharge-energy-generating elements 33*a*. Each of the individual flow paths 34 forms a recess extending in a direction orthogonal to the depth direction of the common flow path 31. A supply port 40 for providing a connection to the common flow path 31 is provided at an end of each individual flow path 34, the end being adjacent to the common flow path 31.

The nozzles 35 are connected to the corresponding individual flow paths 34. The nozzles 35 discharge the ink i in the individual flow paths 34 that is heated and pressed by energy generated in the discharge-energy-generating elements 33*a*.

Specifically, the first covering resin layer 36 is formed by patterning an oxetane resin composition containing an oxetane compound having at least one oxetanyl group in its molecule and a photocationic polymerization initiator as essential components on a surface of the first substrate 33, the surface having the discharge-energy-generating elements 33*a* thereon; and then curing the oxetane resin composition.

The oxetane resin composition constituting the first covering resin layer 36 will now be described. The oxetane compound in the oxetane resin composition has a four-membered ring in which one carbon atom is added to an oxirane ring of an epoxy. The cationic curability of oxetane compounds is superior to that of epoxy compounds. Cationically cured products of these oxetane compounds have significantly high molecular weights, and exhibit a highly reliable mechanical strength having toughness and ability to withstand elongation, and excellent water resistance and chemical resistance, compared with epoxy cured products. Characteristics of the cationically cured products of these oxetane compounds are significantly different from those of hard and brittle epoxy cured products. Furthermore, in the cationically cured products of oxetane compounds, mutagenicity derived from an oxetanyl group of the four-membered ring is not observed, and thus these oxetane compounds are superior to photocurable epoxy resins having a low molecular weight in terms of safety.

Oxetane compounds includes monofunctional oxetane compounds having one oxetanyl group in each molecule and multifunctional oxetane compounds having two or more oxetanyl groups in each molecule. The monofunctional oxetane compounds are represented by general formula (1):

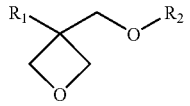

(1)

In general formula (1), $R_1$ represents a hydrogen atom; an alkyl group having 1 to 6 carbon atoms such as a methyl group, an ethyl group, a propyl group, or a butyl group; a fluoroalkyl group having 1 to 6 carbon atoms; an allyl group; an aryl group; a furil group; or a thienyl group. $R_2$ represents an alkyl group having 1 to 6 carbon atoms such as a methyl group, an ethyl group, a propyl group, or a butyl group; an alkenyl group having 2 to 6 carbon atoms such as a 1-propenyl group, a 2-propenyl group, a 2-methyl-1-propenyl group, a 2-methyl-2-propenyl group, a 1-butenyl group, a 2-butenyl group, or a 3-butenyl group; a group having an aromatic ring such as a phenyl group, a benzyl group, a fluorobenzyl group, a methoxybenzyl group, or a phenoxyethyl group; an alkylcarbonyl group having 2 to 6 carbon atoms such as an ethylcarbonyl group, a propylcarbonyl group, or a butylcarbonyl group; an alkoxycarbonyl group having 2 to 6 carbon atoms such as an ethoxycarbonyl group, a propoxycarbonyl group, or a butoxycarbonyl group; an N-alkylcarbamoyl group having 2 to 6 carbon atoms such as an ethylcarbamoyl group, a propylcarbamoyl group, a butylcarbamoyl group, or a pentylcarbamoyl group; or the like.

Bifunctional oxetane compounds having two oxetanyl groups are represented by general formulae (2) and (3):

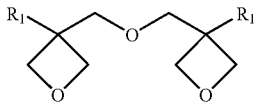

(2)

In general formula (2), each of $R_1$'s represents the same as $R_1$ in general formula (1).

(3)

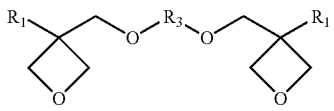

In general formula (3), each of $R_1$'s represents the same as $R_1$ in general formula (1). $R_3$ represents a linear or branched saturated hydrocarbon having 1 to 12 carbon atoms, a linear or branched unsaturated hydrocarbon having 1 to 12 carbon atoms, an aromatic hydrocarbon represented by formula (A), (B), (C), (D), or (E), a carbonyl-group-containing linear or cyclic alkylene represented by formula (F) or (G), or a divalent group selected from carbonyl-group-containing aromatic hydrocarbons represented by formulae (H) and (I). Other bifunctional oxetane compounds include cardo-type compounds, naphthalene-type compounds, and the like.

(A)

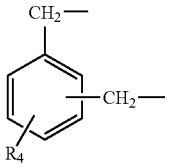

(B)

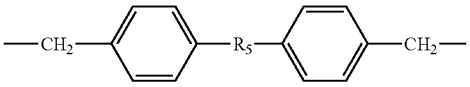

(C)

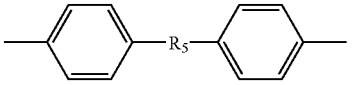

(D)

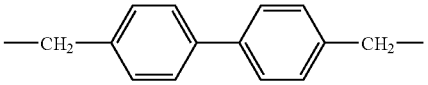

(E)

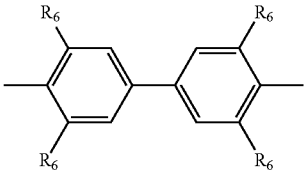

In formula (A), (B), (C), (D), or (E), $R_4$ represents a hydrogen atom, an alkyl group having 1 to 12 carbon atoms, an aryl group, or an aralkyl group; $R_5$ represents —O—, —S—, —$CH_2$—, —NH—, —$SO_2$—, —$CH(CH_3)$—, —$C(CH_3)_2$—, or —$C(CF_3)_2$—; and each of $R_6$'s represents a hydrogen atom or an alkyl group having 1 to 6 carbon atoms.

(F)

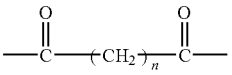

In formula (F), n represents an integer of 1 or more.

(G)

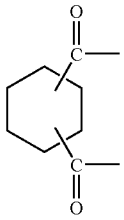

(H)

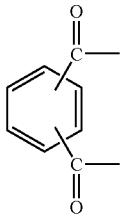

(I)

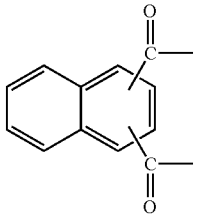

Examples of trifunctional or more than trifunctional oxetane compounds include phenol-novolak-type oxetane compounds represented by general formula (4), cresol-novolak-type oxetane compounds represented by general formula (5), oxetane compounds having a triazine skeleton represented by general formula (6), and oxetane compounds represented by general formula (7). Other trifunctional or more than trifunctional oxetane compounds include etherified products with a hydroxyl-group-containing resin such as poly(hydroxystyrene), a calixarene, or a silicone resin, e.g., silsesquioxane; and copolymers of an alkyl (meth)acrylate and an unsaturated monomer having an oxetane ring.

(4)

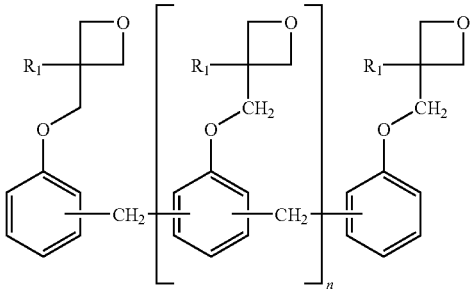

-continued (5)

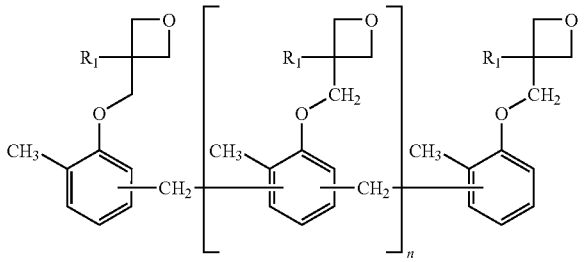

In general formula (4) or (5), each of $R_1$'s represents the same as $R_1$ in general formula (1), and n represents an integer of 1 or more. In these novolak-type oxetane compounds, the number-average number of nuclei is preferably in the range of 3 to 10 (i.e., n is in the range of 1 to 8). This is because when the number-average number of nuclei exceeds 10, the viscosity is increased, and the crosslinking density does not increase because of steric hindrance.

(6)

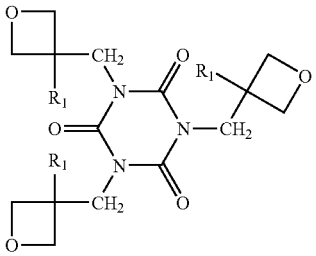

In general formula (6), each of $R_1$'s represents the same as $R_1$ in general formula (1).

(7)

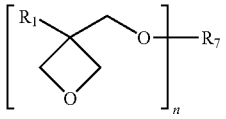

In general formula (7), $R_1$ represents the same as that in general formula (1); $R_7$ represents a branched alkylene group that has 1 to 12 carbon atoms and that is shown in formula (J), (K), or (L), or an aromatic hydrocarbon represented by formula (M), (N), or (P); and n represents the number of functional groups connected to $R_7$ and shown in general formula (7).

(J)

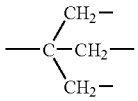

(K)

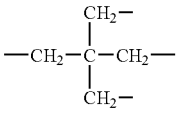

-continued (L)

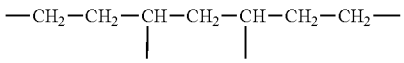

(M)

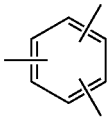

(N)

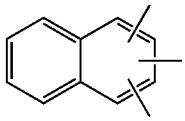

(P)

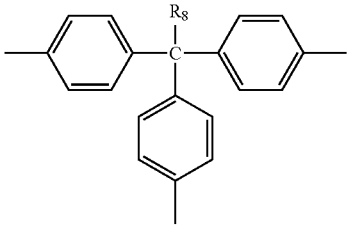

In formula (P), $R_8$ represents a hydrogen atom, an alkyl group having 1 to 6 carbon atoms, or an aryl group.

These oxetane compounds may be used alone or in a mixture of two or more compounds. In order to achieve higher chemical resistance and durability, multifunctional oxetane compounds are preferably selected for use. When a multifunctional oxetane compound is used and a desired viscosity is not obtained, the multifunctional oxetane compound may be diluted with a monofunctional oxetane compound.

Oxetane compounds finally provide cured products having a high degree of cationic curing. The curing rate at the initial stage of curing reaction can be increased by adding an appropriate amount of an epoxy compound, a vinyl ether compound, or the like. In such a case, the amount added is preferably in the range of 5 to 95 weight percent of the oxetane compounds.

Since the first covering resin layer 36 is composed of a cured structure prepared by curing an oxetane resin composition, in addition to the oxetane compound, a cationic polymerization initiator is contained in the oxetane resin composition. When the oxetane resin composition is patterned by irradiating active energy rays such as ultraviolet rays, photocationic polymerization initiators are used. The photocationic polymerization initiators may be used alone or in combinations of two or more initiators.

Examples of the commercially available photocationic polymerization initiators include triarylsulfonium salts, unsubstituted or substituted aryl diazonium salts, and diaryliodonium salts such as CYRACURE UVI-6950 and UVI-6970 manufactured by Union Carbide Corporation; Optomer SP-150, SP-151, SP-152, SP-170, and SP-171 manufactured by Adeka Corporation; CI-2855 manufactured by Nippon Soda Co., Ltd.; and Degacere KI 85 B manufactured by Degussa. An example of sulfonic acid derivatives is PAI-101 manufactured by Midori Kagaku Co., Ltd.

The appropriate amount of photocationic polymerization initiator mixed is in the range of 2 to 40 parts by weight relative to 100 parts by weight of the oxetane compound. When the amount is less than 2 parts by weight, the amount of acid generated by the irradiation of active energy rays is small, resulting in difficulty in forming a pattern. On the other hand, when the amount exceeds 40 parts by weight, the sensitivity is easily decreased because of light absorption by the photocationic polymerization initiator itself. In order to further increase the degree of curing, a thermal polymerization cationic initiator or a photocationic sensitizer may be combined.

The first covering resin layer 36 is composed of an oxetane resin composition containing an oxetane compound having at least one oxetanyl group in its molecule and a photocationic polymerization initiator as essential components. Consequently, a highly reliable mechanical strength having toughness and ability to withstand elongation can be exhibited, thereby preventing problems such as the removal of the first covering resin layer 36 from the first substrate 33 and the generation of cracks.

In addition to the above-described oxetane resin composition containing an oxetane compound and a photocationic polymerization initiator, various additives and the like may be appropriately added to the first covering resin layer 36 according to need. In particular, in order to further improve the adhesive force between the oxetane resin composition and the first substrate 33 serving as a base, a coupling agent is preferably added as an additive. Aluminates, titanates, zirconates, silanes, or the like can be selected as the coupling agent. Among these, silane coupling agents are most preferred.

Examples of aluminate coupling agents include acetoalkoxyaluminum diisopropylate, aluminum diisopropoxymonoethylacetoacetate, aluminum trisethylacetoacetate, and aluminum trisacetylacetonate.

Examples of titanate coupling agents include isopropyltristearoyl titanate, isopropyltris(dioctylpyrophosphate) titanate, isopropyltri(N-aminoethyl-aminoethyl) titanate, tetraoctylbis(ditridecylphosphate) titanate, tetra(2,2-diallyloxymethyl-1-butyl)bis(ditridecyl)phosphate titanate, bis (dioctylpyrophosphate)oxyacetate titanate, and bis (dioctylpyrophosphate)ethylene titanate.

Examples of zirconate coupling agents include zirconium tetrakisacetylacetonate, zirconium dibutoxybisacetylacetonate, zirconium tetrakisethylacetoacetate, zirconium tributoxymonoethylacetoacetate, and zirconium tributoxyacetylacetonate.

Examples of silane coupling agents include vinyltrimethoxysilane, vinyltriethoxysilane, 2-(3,4-epoxycyclohexyl)ethyltrimethoxysilane, 3-glycidoxypropyltrimethoxysilane, 3-mercaptopropyltrimethoxysilane, 3-methacryloxypropyltrimethoxysilane, 3-glycidoxypropylmethyldimethoxysilane, 3-chloropropyltrimethoxysilane, and 3-isocyanatopropyltriethoxysilane.

Among silane coupling agents, amine coupling agents are not preferred because such coupling agents absorb an acid generated from a photocationic polymerization initiator, resulting in decrease in the sensitivity. The amount of additives is 0.1 weight percent or more and less than 1 weight percent of the whole material forming the first covering resin layer 36 containing the oxetane resin composition and the like. When the amount added is less than 0.1 weight percent, the effect for adhesion is not sufficient. When the amount added is 1 weight percent or more, the developing rate is significantly decreased, and underdeveloped part may remain or the resolution may be degraded.

In the first covering resin layer 36, by using an appropriate additive, i.e., a silane coupling agent or the like, the adhesive strength at the interface between the first substrate 33, which is mainly composed of an inorganic component, and the oxetane resin composition, which is an organic material, is increased. Consequently, the adhesiveness of the first covering resin layer 36 to the first substrate 33 can be maintained even in a state in which these are exposed to the ink i, thus improving the reliability of the ink-jet recording head 23.

In the formation of the first covering resin layer 36, the oxetane resin composition may be dissolved in a solvent for use. By dissolving the oxetane resin composition in a solvent, the optimum viscosity and application property can be obtained when the first covering resin layer 36 is formed on the first substrate 33 so as to have a desired film thickness.

Any solvents that can dissolve oxetane compounds and other additives can be used. Examples of the solvent include ketones such as methyl ethyl ketone and cyclohexanone; aromatic hydrocarbons such as toluene, xylene, and tetramethylbenzene; glycol ethers such as Cellosolve, Methyl Cellosolve, Butyl Cellosolve, Carbitol, Methyl Carbitol, Butyl Carbitol, propylene glycol monomethyl ether, propylene glycol monoethyl ether, dipropylene glycol diethyl ether, and triethylene glycol monoethyl ether; acetates such as ethyl acetate, butyl acetate, Cellosolve acetate, Butyl cellosolve acetate, Carbitol acetate, Butyl carbitol acetate, propylene glycol monomethyl ether acetate, and dipropylene glycol monomethyl acetate; alcohols such as ethanol or propanol, ethylene glycol, and propylene glycol; aliphatic hydrocarbons such as octane and decane; petroleum solvents such as petroleum ether, petroleum naphtha, hydrogenated petroleum naphtha, and solvent naphtha; and terpenes such as limonene. These solvents can provide satisfactory solubility of oxetane resin compositions. Among these, aliphatic hydrocarbons and petroleum solvents can be used as a solvent that does not dissolve an ink flow path pattern 41 of a soluble resin layer used for forming the pattern of the individual flow paths 34 of the ink-jet recording head 23 described below and that can dissolve the oxetane resin compositions. In the petroleum solvents, the solubility for the soluble resin layer used for forming the pattern of the individual flow paths 34 is low, and thus deformation of the shape of the ink flow path pattern 41 does not easily occur.

As described above, the first covering resin layer 36 is composed of an oxetane resin composition containing an oxetane compound having at least one oxetanyl group in its molecule and a photocationic polymerization initiator as essential components. Consequently, the stress can be reduced, a highly reliable mechanical strength having toughness and ability to withstand elongation can be exhibited, thereby preventing problems such as the removal of the first covering resin layer 36 from the first substrate 33 and the generation of cracks. In the ink-jet recording head 23 having such a first covering resin layer 36, the production yield and the quality are improved, and high reliability can be achieved for a long time.

The first covering resin layer 36 is composed of a cured product of an oxetane resin composition. Since the stress applied by the cured product of the oxetane resin composition is smaller than that by a cured product of an epoxy resin, the removal of the first covering resin layer 36 from the first substrate 33 can be reliably prevented, compared with the case where the first covering resin layer 36 is formed using the cured product of the epoxy resin. Furthermore, the first covering resin layer 36 has water resistance and chemical resistance due to the oxetane compound.

Furthermore, since the first covering resin layer 36 is composed of an oxetane resin composition, the first covering resin layer 36 can be formed so as to have an elongated shape or a large thickness. Accordingly, complex and minute individual flow paths 34 and nozzles 35 can also be formed precisely and easily.

Furthermore, when the first covering resin layer 36 contains the optimal additive, i.e., a silane coupling agent or the like, in addition to the oxetane resin composition, the adhesiveness to the first substrate 33 can be further improved. Accordingly, the removal of the first covering resin layer 36 from the first substrate 33 can be more reliably prevented.

The second substrate 37, which is bonded on another side of the recess 32*a* of the ink supply component 32, is bonded to the ink supply component 32 with an adhesive. This second substrate 37 is provided in order that the height of one side of the recess 32*a* to which the first substrate 33 is bonded is the same as the height of the other side. The second substrate 37 is provided so as to have the same thickness as that of the first substrate 33. The material of the second substrate 37 is not limited, and the second substrate 37 may be composed of a silicon substrate as in the first substrate 33.

The second covering resin layer 38 is formed on the second substrate 37 by spin coating or the like. The second covering resin layer 38 is formed in order that the height of one side (a first side) of the recess 32*a* of the ink supply component 32 having the first covering resin layer 36 thereon is the same as the height of another side (a second side) including the second covering resin layer 38. The second covering resin layer 38 is provided so as to have the same thickness as that of the first covering resin layer 36. The material of the second covering resin layer 38 is not limited, and the second covering resin layer 38 may be composed of an oxetane resin composition as in the first covering resin layer 36. The components provided at the second side of the recess 32*a*, the components being used for adjusting the height of the second side to be the same as the height of the first side, are not limited to the second substrate 37 and the second covering resin layer 38. The material and the structure of the components are not limited as long as the height of the second side of the recess 32*a* can be the same as the height of the first side of the recess 32*a*.

The top plate 39 is bonded on a discharge face 36*a* of the first covering resin layer 36 from which the ink i is discharged and the second covering resin layer 38. The top plate 39 closes the opening of the side of the discharge face 36*a* of the common flow path 31 and constitutes a part of the common flow path 31.

In the ink-jet recording head having the above structure, the first substrate 33 and the first covering resin layer 36 are provided at the first side of the recess 32*a* of the ink supply component 32, and the second substrate 37 and the second covering resin layer 38 are provided at the second side of the recess 32*a*. Furthermore, the top plate 39 is provided on the first covering resin layer 36 and the second covering resin layer 38. The ink-jet recording head 23 includes the common flow path 31 surrounded by the ink supply component 32, an end face of the first substrate 33, an end face of the first covering resin layer 36, an end face of the second substrate 37, an end face of the second covering resin layer 38, and the top plate 39. Furthermore, the individual flow paths 34 constituting liquid chambers in which the discharge-energy-generating elements 33*a* are surrounded by the first substrate 33 and the first covering resin layer 36 are provided so as to be continuous from the common flow path 31. In this ink-jet recording head 23, the ink i supplied from the ink cartridge 11 is supplied to the common flow path 31, and the ink i supplied to the common flow path 31 is supplied to the individual flow paths 34.

In the ink-jet recording head 23, the ink i is supplied from the ink cartridge 11 to the common flow path 31, the ink i is then supplied from the common flow path 31 to the individual flow paths 34 through the supply ports 40. The supplied ink i is heated and pressed by the discharge-energy-generating elements 33*a*, and is then discharged from the nozzles 35 in the form of a droplet.

Figure 6A:
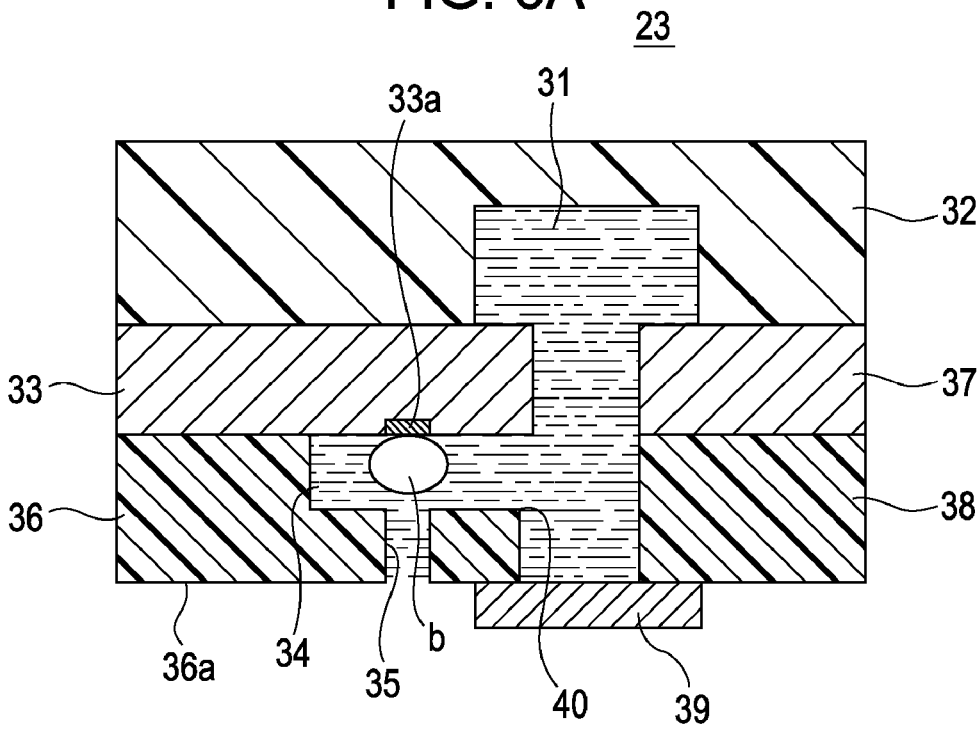
FIG. 6A is a cross-sectional view that schematically shows the ink-jet recording head in a state in which a bubble is formed on a discharge-energy-generating element.
Figure 6B:
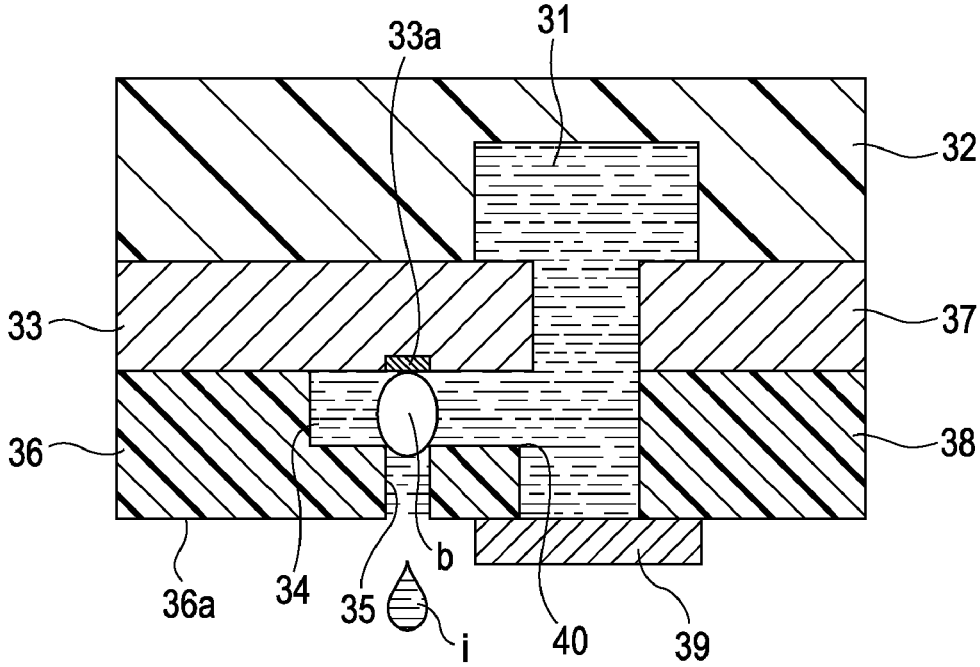
FIG. 6B is a cross-sectional view that schematically shows the ink-jet recording head in a state in which ink is discharged from a nozzle.

Specifically, in the ink-jet recording head 23, when a pulse current is supplied to the discharge-energy-generating element 33*a* to rapidly heat the discharge-energy-generating element 33*a*, as shown in FIG. 6A, a bubble b is formed in the ink that is in contact with the discharge-energy-generating elements 33*a*. As shown in FIG. 6B, the ink-jet recording head 23 then pressurizes the ink i while expanding the bubble b, and discharges the pressed ink i from the nozzle 35 in the form of a droplet. In the ink-jet recording head 23, after the ink i is discharged in the form of a droplet, the ink i is supplied from the ink cartridge 11 to the common flow path 31, and the ink i is then supplied to the individual flow path 34 through the supply port 40. Thus, the ink-jet recording head 23 is again returned to the state before discharge. This operation is repeated, thereby continuously discharging the ink i.

Next, a method of producing the ink-jet recording head 23 will be described.

Figure 7:
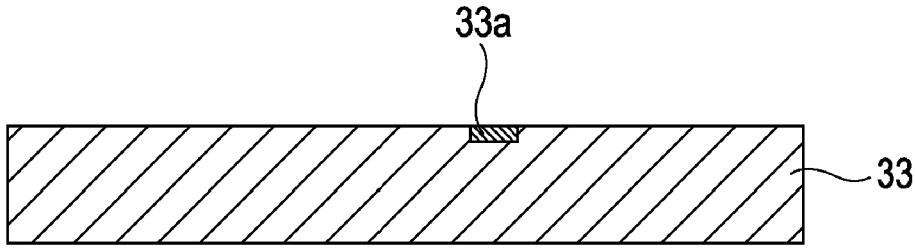
FIG. 7 is a cross-sectional view of a substrate on which a discharge-energy-generating element is provided.

First, as shown in FIG. 7, a silicon (Si) substrate serving as the first substrate 33 is prepared. An electrothermal conversion element serving as the discharge-energy-generating element 33*a* is formed at a predetermined position on a surface of the first substrate 33 by a semiconductor process or the like.

Figure 8:
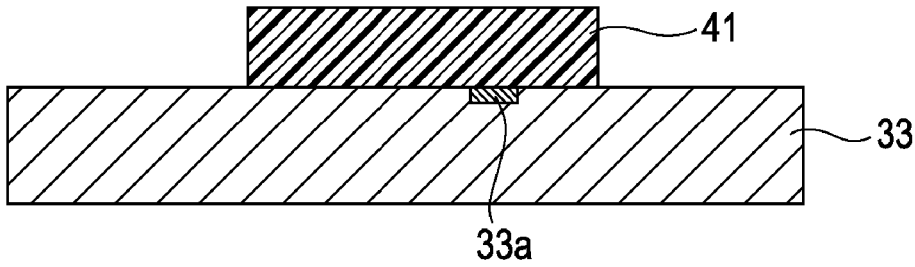
FIG. 8 is a cross-sectional view showing a state in which an ink flow path pattern is formed on the substrate using a soluble resin.

Subsequently, for example, a positive-type resist that is mainly composed of a novolak resin (PMER-P-LA900PM manufacture by Tokyo Ohka Kogyo Co., Ltd.) is applied as a soluble resin layer on the surface of the first substrate 33 having the discharge-energy-generating element 33*a* thereon while the number of revolutions of a spin coater is controlled. The positive-type resist is then pre-baked on a hot plate, for example, at 110° C. for six minutes. A pattern exposure of the individual flow paths 34 is then performed with, for example, a mirror projection aligner (MPA-600FA) manufactured by Canon Inc. Thus, as shown in FIG. 8, an ink flow path pattern 41 is formed with the soluble resin layer on an area where the individual flow path 34 is formed. In this step, the light exposure is, for example, 800 mJ/cm$^2$.

Next, the resist is developed. In the development, a dip development is performed with, for example, a P-7G special developer (3% TMAH (tetramethylammonium hydroxide solution)), and the first substrate 33 is then rinsed with running pure water. The ink flow path pattern 41 composed of the soluble resin is formed in order to provide the individual flow path 34 disposed between the common flow path 31 and the discharge-energy-generating element 33*a*. The positive-type resist layer is formed so as to have a thickness of about 10 μm after the development.

Figure 9:
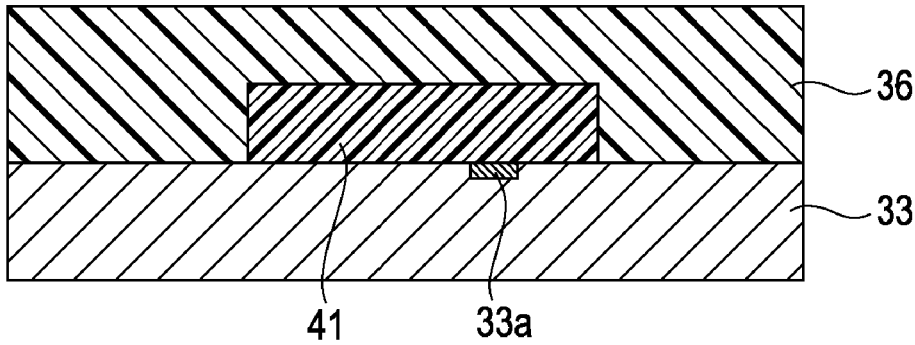
FIG. 9 is a cross-sectional view showing a state in which a first covering resin layer is formed on the ink flow path pattern.

Subsequently, the above-described oxetane resin composition is dissolved in petroleum naphtha or the like, which does not dissolve the ink flow path pattern 41 composed of the positive-type resist, in a concentration of about 50 weight percent to prepare a solution that also contains an additive and the like. As shown in FIG. 9, the solution is then applied on the ink flow path pattern 41 by spin coating to form the photosensitive first covering resin layer 36 containing the oxetane resin composition, the additive, and the like. This photosensitive first covering resin layer 36 is formed so that the thickness on the ink flow path pattern 41 is, for example, about 20 μm.

Figure 10:
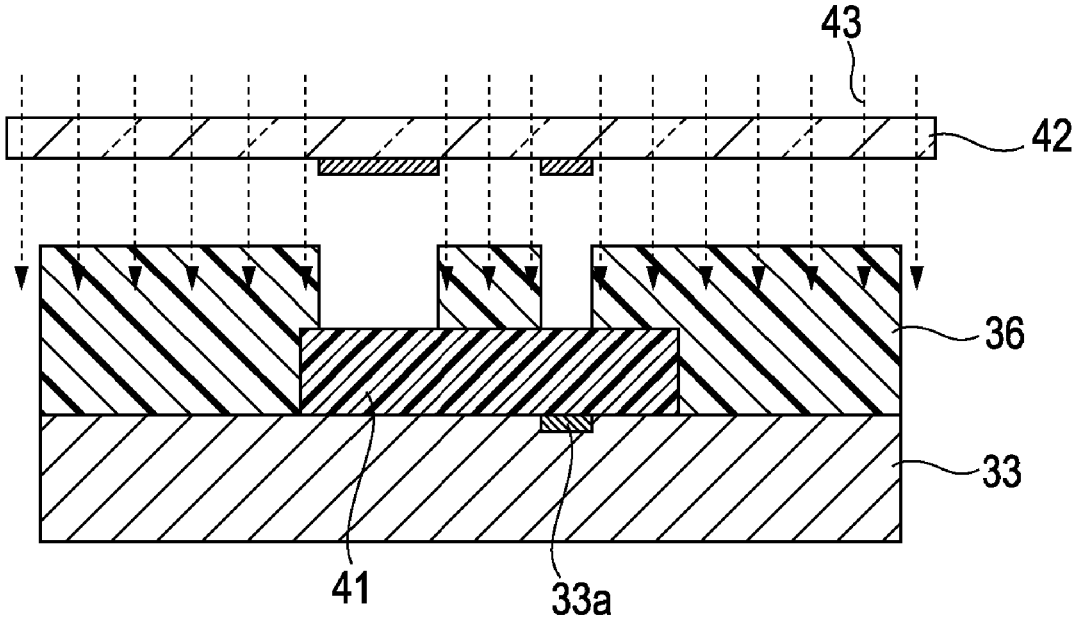
FIG. 10 is a cross-sectional view showing a state in which the first covering resin layer is irradiated with active energy rays.

Subsequently, as shown in FIG. 10, a pattern exposure is performed with a mirror projection aligner (MPA-600FA) manufactured by Canon Inc. or the like to form the nozzle 35 and the ink supply port 40. In the pattern exposure, the first covering resin layer 36 is irradiated with active energy rays 43 through a mask 42 having a pattern designed so that areas corresponding to the nozzle 35 and the ink supply port 40 are not exposed. In this step, the light exposure is, for example, 800 mJ/cm$^2$, and an after baking is performed at 65° C. for about 60 minutes.

Figure 11:
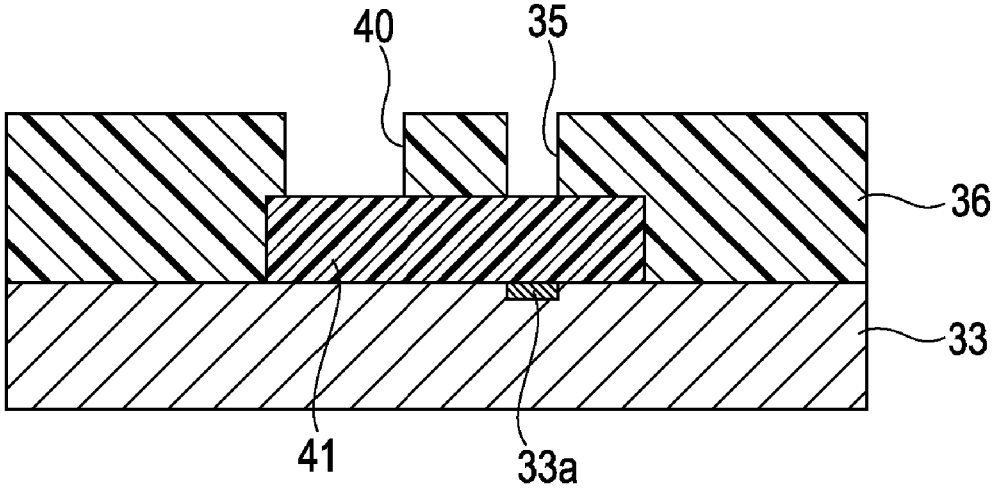
FIG. 11 is a cross-sectional view showing a state in which the first covering resin layer is patterned.

Subsequently, as shown in FIG. 11, areas of the photosensitive first covering resin layer 36 that were not exposed are developed with petroleum naphtha. The first substrate 33 is then rinsed by dipping in isopropyl alcohol (IPA) to remove underdeveloped areas. Thus, the areas of the first covering resin layer 36 that were not exposed are removed to form the nozzle 35 and the ink supply port 40. The diameter of the nozzle 35 is about 15 μm. Since the ink flow path pattern 41 is not dissolved in petroleum naphtha, in this step, the ink flow path pattern 41 is negligibly dissolved and remains.

Figure 12:
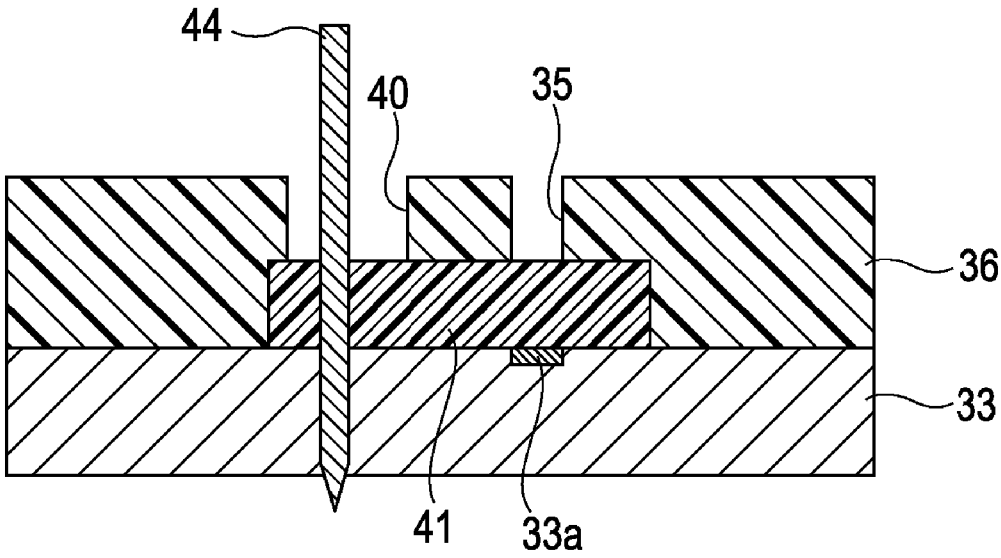
FIG. 12 is a cross-sectional view showing a state in which the product prepared by forming the ink flow path pattern and the first covering resin layer on the substrate is cut with a dicer.

The first covering resin layer 36 having a plurality of the same shapes or different shapes is formed on the first substrate 33 at one time. In this stage, as shown in FIG. 12, the first substrate 33 is cut into pieces with a dicer 44, for example, a DAD-561 manufactured by Disco Corporation. As described above, since the ink flow path pattern 41 still remains in this step, the invasion of contamination generated during cutting of the first substrate 33 into the individual flow path 34 can be prevented.

Figure 13:
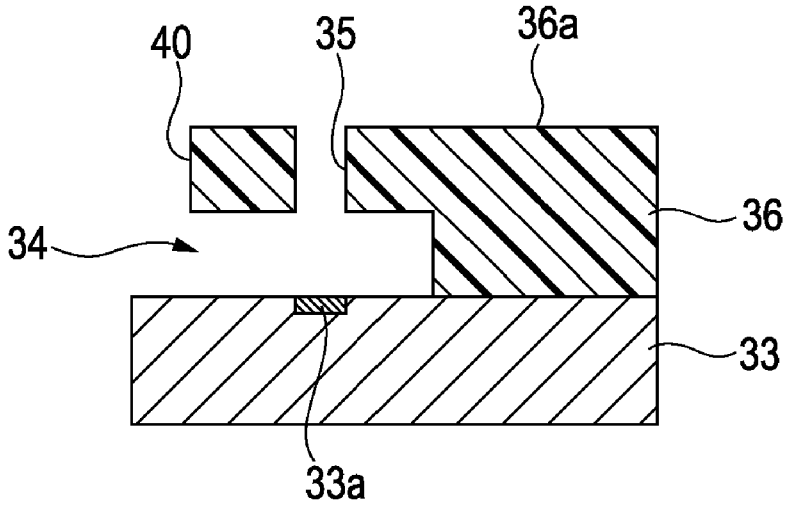
FIG. 13 is a cross-sectional view showing a state in which the ink flow path pattern is formed and the soluble resin is removed by dissolving.

Subsequently, the cut substrates are placed on a chip tray or the like. A solution of propylene glycol monomethyl ether acetate is used as, for example, a polar solvent that can dissolve the positive-type resist. The substrates are immersed in the solution of propylene glycol monomethyl ether acetate while ultrasonic waves are being applied. Consequently, as shown in FIG. 13, the remaining ink flow path pattern 41 is removed by dissolving.

A post-cure is then performed at 150° C. for about one hour to completely cure the photosensitive first covering resin layer 36.

Subsequently, as shown in FIGS. 4 and 5, the first substrate 33 having the first covering resin layer 36 is bonded on one side of the recess 32*a* of the ink supply component 32, and the second substrate 37 having the second covering resin layer 38 is bonded on the other side thereof. Furthermore, the top plate 39 that closes the side of the discharge face 36*a* of the ink supply component 32 is bonded on the discharge face 36*a* of the first covering resin layer 36 and the second covering resin layer 38. Thus, the ink-jet recording head 23 can be produced.

While the ink i is not discharged and printing is not performed, the head cap 24 for protecting the discharge face 36*a* of the ink-jet recording head 23 closes the discharge face 36*a* of the ink-jet recording head 23 to protect the nozzles 35 from drying and the like. In performing printing, when the head cap 24 moves from the bottom surface of the head cartridge 2, the head cap 24 removes extra ink adhered to the discharge face 36*a* with a cleaning roller 24*a* shown in FIG. 14 to clean the discharge face 36*a*.

In the ink-jet recording head 23, the first covering resin layer 36 is composed of an oxetane resin composition having toughness and ability to withstand elongation. Consequently, even when a load is applied to the discharge face 36*a* during the cleaning of the discharge face 36*a* with the cleaning roller 24*a*, the removal of the first covering resin layer 36 from the first substrate 33 can be prevented.

As shown in FIG. 1, in the main body 3 to which the head cartridge 2 is attached, the head cartridge 2 is attached to a head-cartridge-attaching part 51. Furthermore, a paper feed tray 53 in which stacked recording paper P before printing is accommodated is attached to a paper feed opening 52 provided at the lower side of the front face of the main body 3. A paper delivery tray 55 for accommodating printed recording paper P is attached to a paper delivery opening 54 provided at the upper side of the front face of the main body 3.

Figure 14:
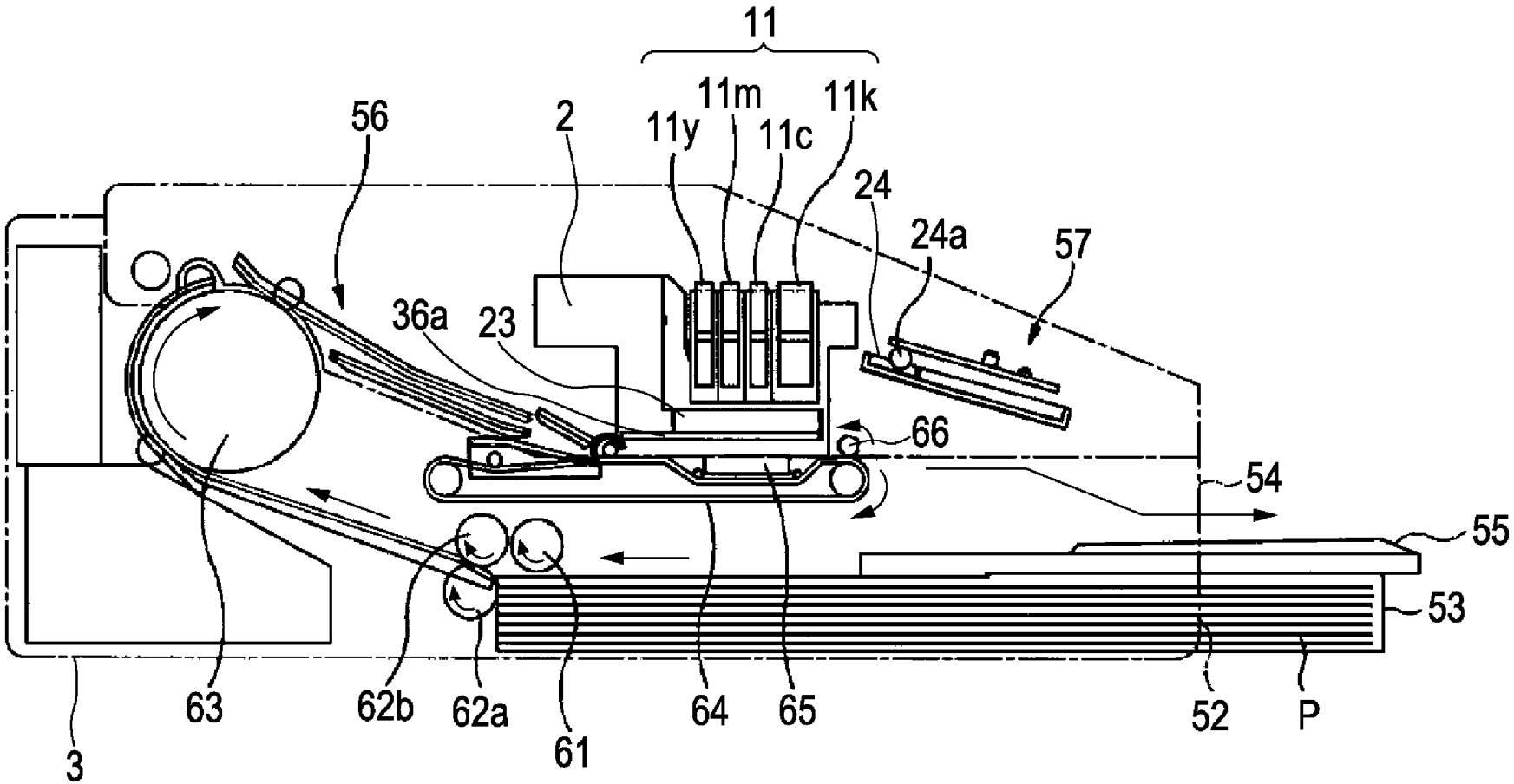
FIG. 14 is a perspective side view showing a part of the ink-jet printer apparatus.

As shown in FIG. 14, a paper feeding/delivering mechanism 56 for transferring the recording paper P and a head cap opening/closing mechanism 57 for opening or closing the head cap 24 provided on the discharge face 36*a* of the head cartridge 2 are provided in the main body 3.

According to the above structure, the printer apparatus 1 is controlled by a controller provided in a control circuit that controls the current supplied to the paper feeding/delivering mechanism 56, the head cap opening/closing mechanism 57, and the ink-jet recording head 23 on the basis of printing data input from an information processing unit provided at the outside.

Specifically, in the printer apparatus 1, when a command of the starting of printing is sent to the controller by the operation of an operation button 3*a* provided on the main body 3, the paper feeding/delivering mechanism 56 and the head cap opening/closing mechanism 57 are driven by a control signal from the controller, and the printer apparatus 1 is ready for printing, as shown in FIG. 14.

In the printer apparatus 1, the head cap 24 is moved by the head cap opening/closing mechanism 57 to the side of the front face on which the paper feed tray 53 and the paper delivery tray 55 are provided, relative to the head cartridge 2. Consequently, in the printer apparatus 1, the nozzles 35 provided on the discharge face 36*a* of the ink-jet recording head 23 are exposed to the outside, and thus the ink i is ready to be discharged.

In the paper feeding/delivering mechanism 56 of the printer apparatus 1, recording paper P is drawn from the paper feed tray 53 by a paper feed roller 61, and single recording paper P drawn by a pair of separation rollers 62*a* and 62*b* that rotate in directions opposite to each other is transferred to a reversing roller 63 to reverse the transferring direction. The recording paper P is then transferred to a transfer belt 64 provided at a position facing the discharge face 36*a* of the ink-jet recording head 23. In the printer apparatus 1, the recording paper P transferred to the transfer belt 64 is supported at a predetermined position by a platen plate 65 so as to face the discharge face 36*a*.

Subsequently, in the printer apparatus 1, the discharge-energy-generating elements 33*a* provided in the ink-jet recording head 23 are heated on the basis of control signals of printing data. In the printer apparatus 1, as shown in FIGS. 6A and 6B, when the discharge-energy-generating element 33*a* is heated, the ink i is discharged in the form of a droplet from the nozzle 35 to the recording paper P transferred to a printing position. Thus, for example, images and characters that are composed of ink dots are printed on the recording paper P.

In the printer apparatus 1, when ink droplets i are discharged from the nozzles 35, the ink i is replenished by the same amount as the discharged amount of ink from the ink cartridge 11 to the ink-jet recording head 23 through the connecting part 25.

Subsequently, in the printer apparatus 1, the printed recording paper P is fed to the paper delivery opening 54 by the transfer belt 64 rotating in the direction of the paper delivery opening 54, and a paper delivery roller 66 that faces the transfer belt 64 and that is provided at the side of the paper delivery opening 54.

In the printer apparatus 1, printing is performed on the recording paper P as described above. In the printer apparatus 1, the first covering resin layer 36 constituting the individual flow paths 34 and the nozzles 35 of the ink-jet recording head 23 is composed of an oxetane resin composition. Consequently, the stress applied to the first covering resin layer 36 is low, a highly reliable mechanical strength having toughness and ability to withstand elongation can be exhibited, and problems such as the removal of the first covering resin layer 36 from the first substrate 33 and the generation of cracks can be prevented. Since the deformation of the shape of the individual flow paths 34 can be prevented in the printer apparatus 1, the ink i can be discharged from the nozzles 35 in the predetermined direction at a constant volume and a constant discharging rate.

Furthermore, in the printer apparatus 1, the first covering resin layer 36 is formed using an oxetane resin composition, thereby obtaining water resistance and chemical resistance.

Furthermore, when the first covering resin layer 36 of the printer apparatus 1 contains the optimal additive, i.e., a silane coupling agent or the like, in addition to the oxetane resin composition, the adhesiveness to the first substrate 33 can be further improved. Consequently, the removal of the first covering resin layer 36 from the first substrate 33 can be prevented more reliably.

Consequently, in the printer apparatus 1, high-quality printed matters can be obtained, and high reliability can also be achieved for a long time.

In the above description of the printer apparatus 1, electrothermal conversion elements are used as an example of the discharge-energy-generating elements 33*a*. However, the discharge-energy-generating elements 33*a* are not limited thereto. For example, the printer apparatus 1 may have an electromechanical conversion system in which the ink i is electromechanically discharged from nozzles by electromechanical conversion elements such as piezoelectric elements.

Furthermore, the embodiment has been described using an example of a printer apparatus, but the application of the present invention is not limited thereto. The present invention can be widely applied to other liquid discharge apparatuses such as a facsimile machine or a copy machine.

The embodiment has been described using an example of a line printer apparatus 1, but the application of the present invention is not limited thereto. For example, the present invention can be applied to a serial printer apparatus in which a head cartridge is moved in a direction substantially orthogonal to the running direction of the recording paper P.

EXAMPLES

Physical properties of an oxetane resin composition constituting a first covering resin layer were examined, and ink resistance and printed image quality of an ink-jet recording head including the first covering resin layer composed of the oxetane resin composition were evaluated.

Examination of Physical Properties of Oxetane Resin Composition

In order to examine a problem in resins, i.e., the internal stress present after curing of resins, the following experiments were performed. The internal stress was evaluated by measuring the thickness before curing of a resin and the thickness after curing of the resin. When the thickness after curing of a resin is equal to the thickness before curing, it is believed that the internal stress due to a volume change caused by curing of the resin is extremely small.

Example 1

In Example 1, a solution containing an oxetane resin composition shown in Table 1 was spin-coated on a wafer with a diameter of six inches. In this step, the solution was applied so that the layer after being pre-baked on a hot plate at 90° C. for five minutes had a thickness of 20 μm. The wafer was then exposed with a mirror projection aligner (MPA-600FA manufactured by Canon Inc.) at a light exposure of 1 J/cm$^2$. The wafer was post-baked on a hot plate at 90° C. for five minutes, and was then cured at 200° C. for one hour to prepare a cured film of the oxetane resin composition.

TABLE 1

| | |
|---|---|
| Phenol-novolak-type oxetane compound (Average number of nuclei: 3) | 100 parts by weight |
| Photocationic polymerization initiator (SP-170: from Adeka Corporation) | 2 parts by weight |
| Silane coupling agent (2-(3,4-Epoxycyclohexyl)ethyltrimethoxysilane) | 0.5 parts by weight |
| Organic solvent (Petroleum naphtha, Ipsol 150: from Idemitsu Kosan Co., Ltd.) | 100 parts by weight |

Comparative Example 1

In Comparative Example 1, a cured film of an alicyclic epoxy resin composition was prepared as in Example 1 using a solution containing an alicyclic epoxy resin composition shown in Table 2.

TABLE 2

| | |
|---|---|
| Alicyclic epoxy resin (EHPE-3150: Daicel Chemical Industries, Ltd.) | 100 parts by weight |
| Photocationic polymerization initiator (SP-170: from Adeka Corporation) | 2 parts by weight |
| Silane coupling agent (2-(3,4-Epoxycyclohexyl)ethyltrimethoxysilane) | 0.5 parts by weight |
| Organic solvent (Xylene) | 100 parts by weight |

The thickness of films after being cured on the hot plate at 200° C. for one hour was measured using the cured films prepared in Example 1 and Comparative Example 1. According to the results, in the cured film containing the oxetane resin composition shown in Table 1, the film thickness was not decreased. In contrast, in the cured film containing the alicyclic epoxy resin composition shown in Table 2, the film thickness was decreased.

Furthermore, the stress of the cured films was measured with a thin-film stress measurement system. According to the results, the stress of the cured film containing the oxetane resin composition shown in Table 1 was markedly lower than that of the cured film containing the alicyclic epoxy resin composition shown in Table 2.

Evaluations of Ink Resistance and Printed Image Quality of Ink-jet Recording Head

Example 2

In Example 2, an ink-jet recording head 23 shown in FIG. 4 was produced as follows. First, on a first substrate 33 having a discharge-energy-generating element 33*a* shown in FIG. 7, for example, a positive-type resist that was mainly composed of a novolak resin (PMER-P-LA900PM manufacture by Tokyo Ohka Kogyo Co., Ltd.) was applied as a soluble resin layer. The positive-type resist was then pre-baked on a hot plate at 110° C. for six minutes. A pattern exposure of an individual flow path 34 was then performed with a mirror projection aligner (MPA-600FA) manufactured by Canon Inc. Thus, as shown in FIG. 8, an ink flow path pattern 41 was formed with the soluble resin layer at an area where the individual flow path 34 is formed. In this step, the light exposure was 800 mJ/cm$^2$.

A dip development was performed with a P-7G special developer (3% TMAH (tetramethylammonium hydroxide solution)) to develop the resist, and the first substrate 33 was then rinsed with running pure water. After the development, the positive-type resist had a thickness of 10 μm.

Subsequently, the oxetane resin composition shown in Table 1 was dissolved in petroleum naphtha, which does not dissolve the ink flow path pattern 41, in a concentration of about 50 weight percent to prepare a solution. As shown in FIG. 9, the solution was then applied on the ink flow path pattern 41 by spin coating to form a photosensitive first covering resin layer 36 composed of the oxetane resin composition shown in Table 1. In the first covering resin layer 36, the thickness disposed on the ink flow path pattern 41 was 20 μm.

Subsequently, as shown in FIG. 10, a pattern exposure of the first covering resin layer 36 was performed with a mirror projection aligner (MPA-600FA) manufactured by Canon Inc. to form a nozzle 35 and an ink supply port 40. In the pattern exposure, the first covering resin layer 36 was irradiated with active energy rays 43 through a mask 42 having a pattern designed so that areas corresponding to the nozzle 35 and the ink supply port 40 were not exposed. In this step, the light exposure was 800 mJ/cm$^2$, and an after baking was performed at 65° C. for 60 minutes.

Subsequently, as shown in FIG. 11, areas of the photosensitive first covering resin layer 36 that had not been exposed were developed with petroleum naphtha. The first substrate 33 was then rinsed by dipping in IPA to remove underdeveloped areas. Thus, the areas of the first covering resin layer 36 that had not been exposed were removed to form the nozzle 35 and the ink supply port 40. The diameter of the nozzle 35 was 15 μm. In this step, the ink flow path pattern 41 was negligibly dissolved and remained.

Furthermore, as shown in FIG. 12, the first substrate 33 was cut with a dicer 44 (DAD-561 manufactured by Disco Corporation) so as to have a predetermined size. Since the ink flow path pattern 41 still remained in this step, the invasion of contamination generated during cutting of the first substrate 33 into the individual flow path 34 was prevented.

Subsequently, the cut substrates were placed on a chip tray or the like. A solution of propylene glycol monomethyl ether acetate was used as, for example, a polar solvent that could dissolve the positive-type resist. The substrates were immersed in the solution of propylene glycol monomethyl ether acetate while applying ultrasonic waves. Thus, as shown in FIG. 13, the remaining ink flow path pattern 41 was removed by dissolving.

A post-cure was then performed at 150° C. for one hour to completely cure the photosensitive first covering resin layer 36.

Subsequently, as shown in FIGS. 4 and 5, the first substrate 33 having the first covering resin layer 36 was bonded on one side of a recess 32*a* of an ink supply component 32, and a second substrate 37 having a second covering resin layer 38 was bonded on the other side thereof. Furthermore, a top plate 39 was bonded on a discharge face 36*a* of the first covering resin layer 36 and the second covering resin layer 38, thus producing the ink-jet recording head 23.

Comparative Example 2

In Comparative Example 2, an ink-jet recording head 23 was produced as in Example 2 except that the first covering resin layer 36 was formed using the alicyclic epoxy resin composition shown in Table 2 and that xylene was used for developing the first covering resin layer 36.

An ink immersion test was performed by immersing the ink-jet recording heads 23 produced in Example 2 and Comparative Example 2 in black ink at 60° C. for one week. The black ink used was ink for a LPR-5000 printer apparatus and was composed of pure water, ethylene glycol, a black dye, and the like.

According to the results of the ink immersion test, in the ink-jet recording head 23 of Example 2, in which the oxetane resin composition shown in Table 1 was used as the material of the first covering resin layer 36, a change such as a removal of the first covering resin layer 36 from the first substrate 33 was not observed at all. In contrast, in the ink-jet recording head 23 of Comparative Example 2, in which the alicyclic epoxy resin composition shown in Table 2 was used as the material of the first covering resin layer 36, a removal of a part of the first covering resin layer 36, which might be caused by a stress due to curing, was observed after the immersion in the ink.

The printed image quality was evaluated as follows. The ink-jet recording head 23 of Example 2 or Comparative Example 2 was attached to the above-described printer apparatus, and recording was performed using ink having a composition of pure water/diethylene glycol/black dye=80/17.5/2.5. In the ink-jet recording head 23 of the Example 2, a stable printing could be performed, and the resulting printed matters had a high quality. In contrast, in the ink-jet recording head 23 of Comparative Example 2, the printed image quality was not satisfactory in some cases. Furthermore, in the ink-jet recording head 23 of Comparative Example 2, when the head was observed with an optical microscope after a long-term use, interference fringe, which might be generated by a removal of the covering resin, was observed.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid discharge recording head which discharges a liquid, comprising:

a substrate on which liquid-discharge-energy-generating elements are provided and which constitutes a part of a flow path for supplying the liquid; and a covering resin layer which is provided on the substrate, which constitutes a part of the flow path, and which includes orifices for discharging the liquid, wherein the covering resin layer is composed of an oxetane resin composition containing an oxetane compound having at least one oxetanyl group in its molecule and a photocationic polymerization initiator as essential components, and the oxetane compound has an aromatic ring in its molecule.

2. The liquid discharge recording head according to claim 1, wherein a skeleton of the oxetane compound is a novolak skeleton.

3. The liquid discharge recording head according to claim 2, wherein the number-average number of nuclei of the oxetane compound is in the range of 3 to 10.

4. The liquid discharge recording head according to claim 1, wherein the covering resin layer includes a coupling agent.

5. The liquid discharge recording head according to claim 4, wherein the coupling agent is a silane coupling agent.

6. The liquid discharge recording head according to claim 5, wherein the content of the silane coupling agent is 0.1 weight percent or more and less than 1 weight percent.

7. A liquid discharge recording head which discharges a liquid, comprising:

a liquid supply component having a recess which constitutes a part of a common flow path for supplying the liquid;

a first substrate which is bonded on one side of the recess of the liquid supply component, an end face of which constitutes a part of the common flow path, and on which liquid-discharge-energy-generating elements are provided;

a first covering resin layer which is provided on the first substrate and which includes individual flow paths for supplying the liquid supplied from the common flow path to the periphery of the liquid-discharge-energy-generating elements and orifices for discharging the liquid; a second substrate which is bonded on another side of the recess of the liquid supply component and an end face of which constitutes a part of the common flow path;

a second covering resin layer provided on the second substrate; and a top plate which is provided on the first covering resin layer and the second covering resin layer and which closes the side of a discharge face of the common flow path, wherein the first covering resin layer is composed of an oxetane resin composition containing an oxetane compound having at least one oxetanyl group in its molecule and a photocationic polymerization initiator as essential components.

8. The liquid discharge recording head according to claim 7, wherein the oxetane compound has an aromatic ring in its molecule.

9. The liquid discharge recording head according to claim 8, wherein the skeleton of the oxetane compound is a novolak skeleton.

10. The liquid discharge recording head according to claim 9, wherein the number-average number of nuclei of the oxetane compound is in the range of 3 to 10.

11. The liquid discharge recording head according to claim 7, wherein the first covering resin layer includes a coupling agent.

12. The liquid discharge recording head according to claim 11, wherein the coupling agent is a silane coupling agent.

13. The liquid discharge recording head according to claim 12, wherein the content of the silane coupling agent is 0.1 weight percent or more and less than 1 weight percent.

14. A liquid discharge apparatus comprising:

a liquid discharge recording head which discharges a liquid, wherein the liquid discharge recording head includes a substrate on which liquid-discharge-energy-generating elements are provided and which constitutes a part of a flow path for supplying the liquid; and a covering resin layer which is provided on the substrate, which constitutes a part of the flow path, and which includes orifices for discharging the liquid, and the covering resin layer is composed of an oxetane resin composition containing an oxetane compound having at least one oxetanyl group in its molecule and a photocationic polymerization initiator as essential components, and the oxetane compound has an aromatic ring in its molecule.

15. The liquid discharge apparatus according to claim 14, wherein a skeleton of the oxetane compound is a novolak skeleton.

16. The liquid discharge apparatus according to claim 15, wherein the number-average number of nuclei of the oxetane compound is in the range of 3 to 10.

17. The liquid discharge apparatus according to claim 14, wherein the covering resin layer includes a coupling agent.

18. The liquid discharge apparatus according to claim 17, wherein the coupling agent is a silane coupling agent.

19. The liquid discharge apparatus according to claim 18, wherein the content of the silane coupling agent is 0.1 weight percent or more and less than 1 weight percent.

20. A liquid discharge apparatus comprising:

a liquid discharge recording head which discharges a liquid, wherein the liquid discharge recording head includes a liquid supply component having a recess which constitutes a part of a common flow path for supplying the liquid;

a first substrate which is bonded on one side of the recess of the liquid supply component, an end face of which constitutes a part of the common flow path, and on which liquid-discharge-energy-generating elements are provided;

a first covering resin layer which is provided on the first substrate and which includes individual flow paths for supplying the liquid supplied from the common flow path to the periphery of the liquid-discharge-energy-generating elements and orifices for discharging the liquid;

a second substrate which is bonded on another side of the recess of the liquid supply component and an end face of which constitutes a part of the common flow path;

a second covering resin layer provided on the second substrate; and a top plate which is provided on the first covering resin layer and the second covering resin layer and which closes the side of a discharge face of the common flow path, and the first covering resin layer is composed of an oxetane resin composition containing an oxetane compound having at least one oxetanyl group in its molecule and a photocationic polymerization initiator as essential components.

21. The liquid discharge apparatus according to claim 20, wherein the oxetane compound has an aromatic ring in its molecule.

22. The liquid discharge apparatus according to claim 21, wherein the skeleton of the oxetane compound is a novolak skeleton.

23. The liquid discharge apparatus according to claim 22, wherein the number-average number of nuclei of the oxetane compound is in the range of 3 to 10.

24. The liquid discharge apparatus according to claim 20, wherein the first covering resin layer includes a coupling agent.

25. The liquid discharge apparatus according to claim 24, wherein the coupling agent is a silane coupling agent.

26. The liquid discharge apparatus according to claim 25, wherein the content of the silane coupling agent is 0.1 weight percent or more and less than 1 weight percent.

* * * * *